US009301559B2

(12) United States Patent
McQueer

(10) Patent No.: US 9,301,559 B2
(45) Date of Patent: Apr. 5, 2016

(54) BREAST PROTECTION DEVICE

(71) Applicant: Pamela McQueer, Otsego, MI (US)

(72) Inventor: Pamela McQueer, Otsego, MI (US)

(73) Assignee: Logan Consultants, LLC, Otsego, MI (US)

( * ) Notice: Subject to any disclaimer, the term of this patent is extended or adjusted under 35 U.S.C. 154(b) by 194 days.

(21) Appl. No.: 13/987,475

(22) Filed: Jul. 29, 2013

(65) Prior Publication Data

US 2014/0026302 A1 Jan. 30, 2014

Related U.S. Application Data

(60) Provisional application No. 61/741,929, filed on Jul. 30, 2012.

(51) Int. Cl.

| | |
|---|---|
| ***A41D 13/05*** | (2006.01) |
| ***A41C 3/10*** | (2006.01) |
| ***A41C 3/00*** | (2006.01) |
| ***A41D 13/00*** | (2006.01) |
| *F41H 1/02* | (2006.01) |

(52) U.S. Cl.

CPC ..... *A41D 13/05* (2013.01); *A41C 3/0057* (2013.01); *A41C 3/105* (2013.01); *A41D 13/0017* (2013.01); *A41D 13/0518* (2013.01); *A41D 2400/22* (2013.01); *F41H 1/02* (2013.01)

(58) Field of Classification Search

CPC ..... A41C 3/14; A41C 3/0057; A41C 3/105; A41C 3/10; A41C 3/0035; A41C 3/005; A41C 3/0064; A41C 3/142; A41C 3/144; A41C 3/146; A41C 3/148; A41D 13/0518; A41D 13/0151; A41D 13/0155; A41D 13/0017; A41D 13/05; A41D 1/22; A41D 13/015; F41H 1/02

USPC ..... 2/463, 455, 459, 267, 92, 109; 450/38, 450/39, 57, 54, 55

See application file for complete search history.

(56) References Cited

U.S. PATENT DOCUMENTS

| | | | | | |
|---|---|---|---|---|---|
| 76,894 | A * | 4/1868 | Cook | A41C 3/105 | 450/38 |
| 146,805 | A * | 1/1874 | Cox | A61F 2/52 | 450/38 |
| 1,721,739 | A * | 7/1929 | Kennedy | 2/463 | |
| 2,508,580 | A * | 5/1950 | Mixon | 450/41 | |
| 2,516,129 | A * | 7/1950 | Leo et al. | 450/38 | |
| 2,764,759 | A * | 10/1956 | Gazelle | A41C 3/0035 | 450/38 |
| 3,176,686 | A * | 4/1965 | Barnes | 128/846 | |
| 3,326,218 | A * | 6/1967 | McAlpine | 450/38 | |
| 4,607,640 | A * | 8/1986 | McCusker | A41C 3/10 | 450/1 |
| 4,734,078 | A * | 3/1988 | Moreau | 450/38 | |
| 5,022,887 | A * | 6/1991 | Lawson | 450/54 | |
| 5,244,432 | A * | 9/1993 | Moy Au et al. | 450/54 | |
| 5,281,186 | A * | 1/1994 | Buckley | A41C 3/142 | 2/267 |
| 5,439,409 | A * | 8/1995 | McCracken et al. | 450/31 | |
| 5,769,688 | A * | 6/1998 | Holliday | A41C 3/0057 | 2/2.5 |
| 5,806,103 | A * | 9/1998 | McCracken | A41C 3/10 | 2/267 |

(Continued)

*Primary Examiner* — Amy Vanatta

(74) *Attorney, Agent, or Firm* — Nash & Titus, LLC; Caroline Nash

(57) ABSTRACT

A breast protection device that has a shield. The shield has an inner face and an outer face with a cavity formed there between. A fillable bladder is positioned inside of the cavity. The bladder has a valve opening for filling the bladder. A tube is inserted in the valve for filling means bladder. A method for protecting breast tissue using the breast protection device and a garment having the breast protection device incorporated therein.

19 Claims, 5 Drawing Sheets

(56) References Cited

U.S. PATENT DOCUMENTS 5,823,852 A * 10/1998 Chu ..... A41C 3/105 137/844
6,080,037 A * 6/2000 Lee ..... A41C 3/105 2/67
6,083,080 A * 7/2000 Lawson et al. ..... 450/39
6,461,221 B1 * 10/2002 Stilwell et al. ..... 450/57
6,688,942 B2 * 2/2004 Holliday ..... A41C 3/0057 450/1
6,811,463 B2 * 11/2004 Martz ..... 450/57
8,047,891 B1 * 11/2011 Albritton ..... A41C 3/105 450/38
2007/0155283 A1 * 7/2007 McQueer ..... A41C 3/0057 450/39
2010/0186154 A1 * 7/2010 Krueger ..... 2/459

* cited by examiner

BREAST PROTECTION DEVICE

This application claims the benefit of priority of 61/741,929 filed Jul. 30, 2012.

BACKGROUND OF THE INVENTION

1. Field of the Invention

This invention relates to a breast protection device that is worn in conjunction with a sports bra, sports garment or bullet resistant vest. In the alternative, the sports bra defines a breast protection device.

2. Brief Description of Related Art

There are many types of sports bras on the market. Most are made of stretchy material that compresses the breasts to immobilize them.

SUMMARY OF THE INVENTION

The present invention relates to a breast protection device having a breast shield in the form of a cup or cups that shield and cushion the breast tissue to protect it from blunt impact force. This breast protection device is intended for use in sports, medical applications and/or the military or in any situation where a person desires additional breast protection.

DETAILED DESCRIPTION

The breast protection device of the invention is a breast shield specially designed to protect breast tissue from blunt impact force. The breast shield will be discussed in view of the drawings.

Figure 1:
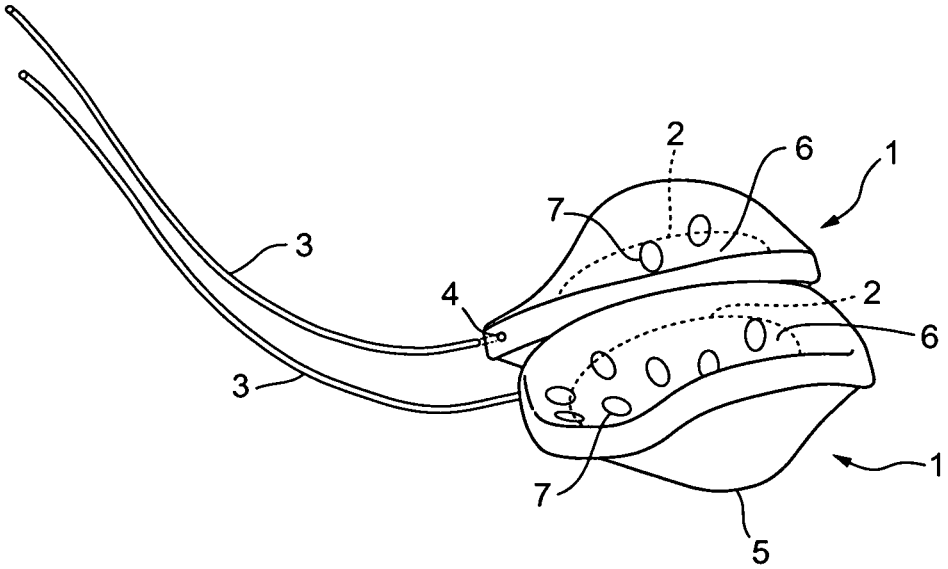
FIG. 1 is a side perspective view of a breast garment shield.
Figure 2A:
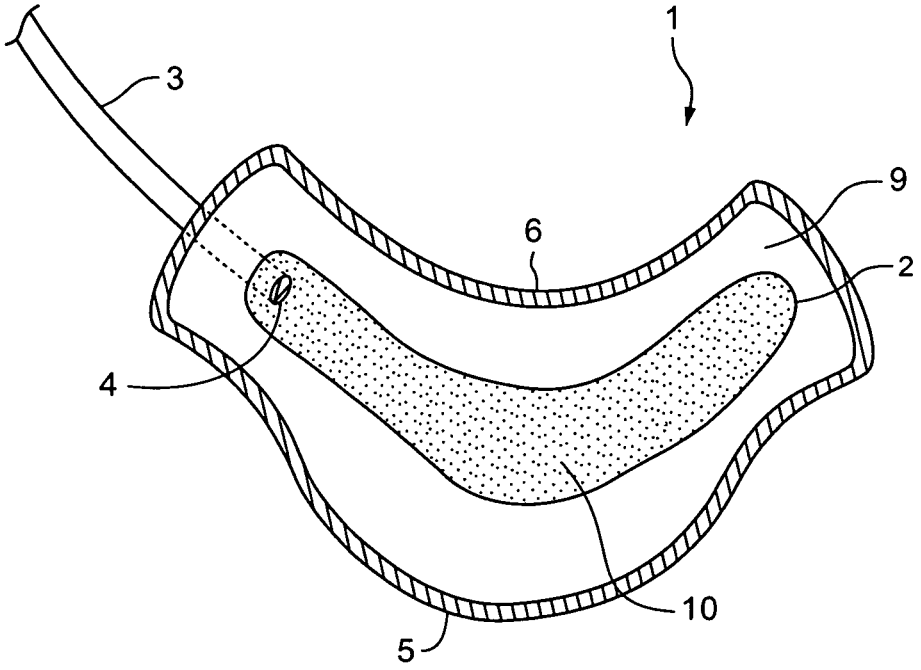
FIG. 2*a* is a cross sectional view of a breast garment shield according to a first embodiment.
Figure 2B:
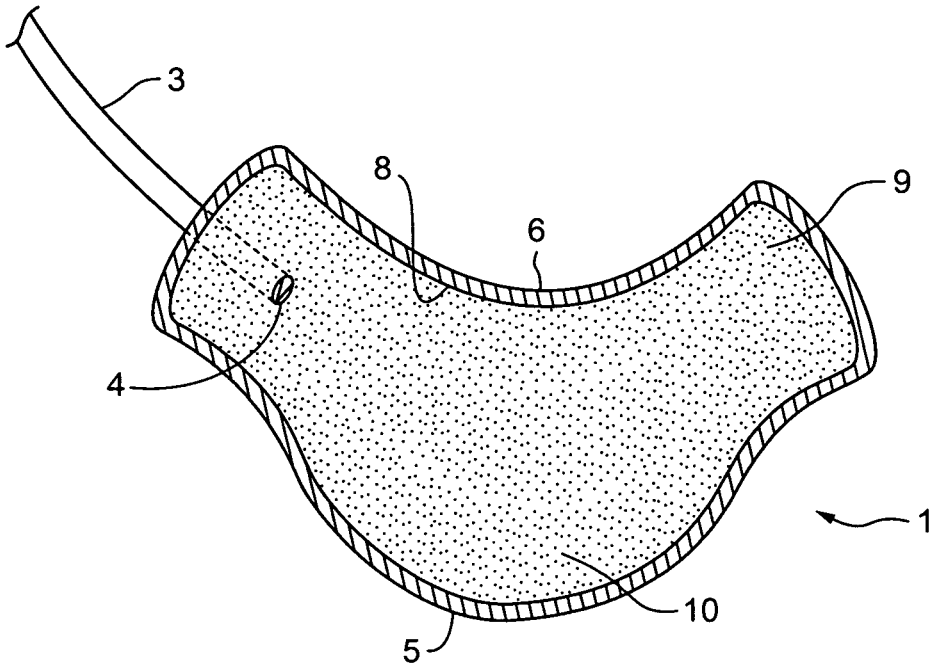
FIG. 2*b* is a cross sectional view of the breast garment shield according to a second embodiment.
Figure 3:
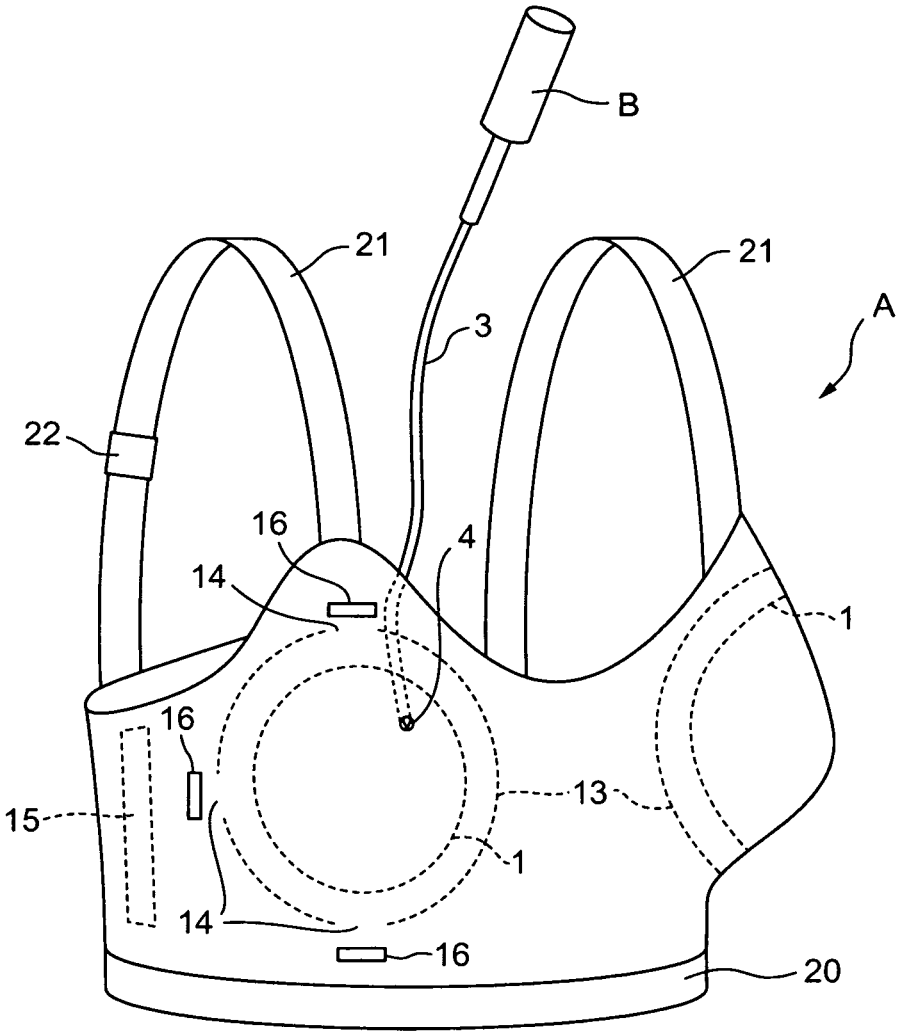
FIG. 3 is a frontal perspective view of a sports bra showing the breast garment shield inserted therein.

As shown in Figures. 1-3, a single breast shield 1 is shown that is concave to accommodate a single breast. The breast shield 1 has an outer face 5 and an inner face 6. As shown in FIG. 2*a*, between the outer face 5 and inner face 6 is a compartment 9 that accommodates a bladder 2. The bladder 2 has a stem 3 and valve system 4. In a preferred embodiment, the inner face 6 and/or outer face 5 defines air passages 7 that permit the skin of the user to breath and add comfort to the user.

The valve system 4 is a one way or two-way but preferably a one way valve permitting air to flow into the bladder and not out of the bladder once it is filled to the desired volume and customized fit. A two-way valve may be used if it is desired to deflate the bladder for storage or packing. The valve may also have one or more of the following characteristics, have a cap, be self-sealing, may receive a needle inflator/tube combination.

A stem or tube 3 is inserted into the valve to deliver a filling substance 10 such as air or other filling substance into the bladder 2. The stem may be stationary or removable. The tube may remain attached or may be detached. It should be understood that the invention is not limited by the use of tubes as long as there is a useful system of filling the bladder or shield with a filling substance.

A bladder 2 is defined as an airtight bag or liquid tight bag. In an alternative embodiment as shown in FIG. 2*b*, the bladder can also be an airtight space defined by the inside surface 8 of the breast shield itself The bladder 2 can be blown up with air or other gaseous substance to expand the outer walls of the bag, thereby enlarging its volume and shape.

The bladder 2 can also be filled with liquid, gel or other force distributing substance 10 that moves force away from the area of impact. The filling substance of the bladder can also be a polymeric substance or any type of substance that is initially liquid upon filling but then transforms into a semi solid or solid state. In this embodiment where the filling substance becomes solid or semi solid, the filling substance can conform to the breast shape of the individual user and maintain the conforming shape for the life of the protection device.

As shown in FIG. 1, the outer face 5 of the shield 1 is a hardened or semi hardened solid surface. The function of the outer surface is to provide a non-penatratable barrier to protect the breast. A bladder 2 is positioned behind the outer face 5. The bladder can fill the entire space or compartment 9 behind the outer face or part of the space. The compartment is designed to be flexible in that it can be made larger upon filling of the bladder or compartment itself and can also be collapsible.

In use a sports bra type garment A has inside packets 13 for receiving the breast protection shields 1. The breast shields 1 are placed inside pockets 13 of a garment, as shown in FIG. 3. The pockets 13 may have closure means 16 such as snaps, hook and eye, Velcro®, buttons, overlapping fabric or other suitable closure means to prevent the breast shields 1 from falling out of the garment. The user puts the garment A on and over their breasts, positioning their breasts inside of the concave shape of the inner face 6 of the shields 1. The user then blows up the bladder 2 with the tube 3. The user can blow up the bladder with a pump B or can blow up the bladder with their mouth by blowing air from their lungs into the tube to the bladder.

A pump canister B or other pump container containing a filling substance 10 may also be attached to the tube 3 to fill up the bladder. The pump B can be removable. The bladder 2 is blown up until a comfortable fit is achieved. An important object of the invention is to fill the bladder 2 or inside surface of the shield 8 to conform to the size and shape of the breast to offer the breast the optimum protection and fit. The amount of filling substance used depends on the physical dimensions of the user's breasts and their comfort level. This object is easily achieved by the user themselves or by the assistance of another person such as a coach, doctor or sport technician.

A breast protection kit is also part of the present invention. The kit contains 1) one or more shields as described herein, 2) a garment with shield receiving pockets for receiving the one or more shields, 3) a means for filling the shields with a filling substance. The kit may include multiple refills or canisters of filling substance.

In the embodiment where there are two separate shields used, each shield is blown up individually as not all breasts are symmetrical in size or shape. The tube 3 preferably remains in place. The tube can also be removed and the bladder 2 stays inflated due to its valve arrangement. The inflation system herein described not only allows the blunt trauma protection for the breast, it also offers a more customized fitt for the female.

Upon impact of an object to the breast, the rigid outer face 5 of the breast shield 1 acts as a protector. The bladder 2 adds additional protection to the breast tissue by absorbing and/or distributing the force laterally. The bladder is similar in many ways to an airbag in a car.

The outer face 5 of the shield 1 can be made by molding a polymeric material into the desired concave shape. The outer shield can be made in different sizes such as small, medium, large and extra large. The outer face of the shield material is a plastic material, preferably polyethylene. More preferably, the outer shield is high-density polyethylene. However, low density polyethylene may also be employed to permit the outer face 5 of the shield to expand slightly as the bladder is filled up. The thicker high-density polyethylene creates more velocity of energy at trauma point. Lower density allows the disbursement to carry through to the outer face allowing the bladder to absorb the blow. It is preferable that the outer face is more rigid than the inner face. The outer face can be somewhat flexible or made of a modular material.

The inner face 6 of the shield 1 is a flexible plastic or foam, preferably made of a low density PVC plastic (Polyvinyl chloride). The inner face should have the properties of being soft, flexible, durable, and elastic so that it can stretch when the bladder expands. It also must conform to the shape of the breast.

The tube 3 can be made of PVC or other suitable material. It allows air to fill the bladder with a basic stem and valve. The tub can extend from the shield upwards to attach to a shoulder strap of the garment allowing the female wearer to pump air into the bladder while participating in her skilled sport on the sidelines, accommodating any exposure of her breast and or chest cavity. The position of the tube may also be from the underside of the bladder or the sides of the bladder or inside surface of shield.

The outer face 5 and the inner face 6 may be glued together or adhered together in some fashion to form a cavity there between. The faces can be molded together, melted together, or adhered in any suitable fashion. They can be two separate and distinct faces or one integral object with the characteristics described herein.

As shown in FIG. 3, the shield 1 fits into a pocket 13 of a sports bra A, sports garment, camisole, vest, shirt or bullet resistant garment. The pocket 13 is oriented on the garment where the breasts will be. The shield 1 accommodates the breasts.

The pocket 13 can have openings 14 in one or more places such as a top opening 14, side opening 14, or bottom opening 14 shown in FIG. 3. As shown in FIG. 3, the garment can have rigid or semi rigid boning 15 around or in the vicinity of the pockets 13 to further support the breasts. It is preferred that the boning be placed vertically on the outside edge of each breast in the vicinity of under the wearer's arms.

Figure 4:
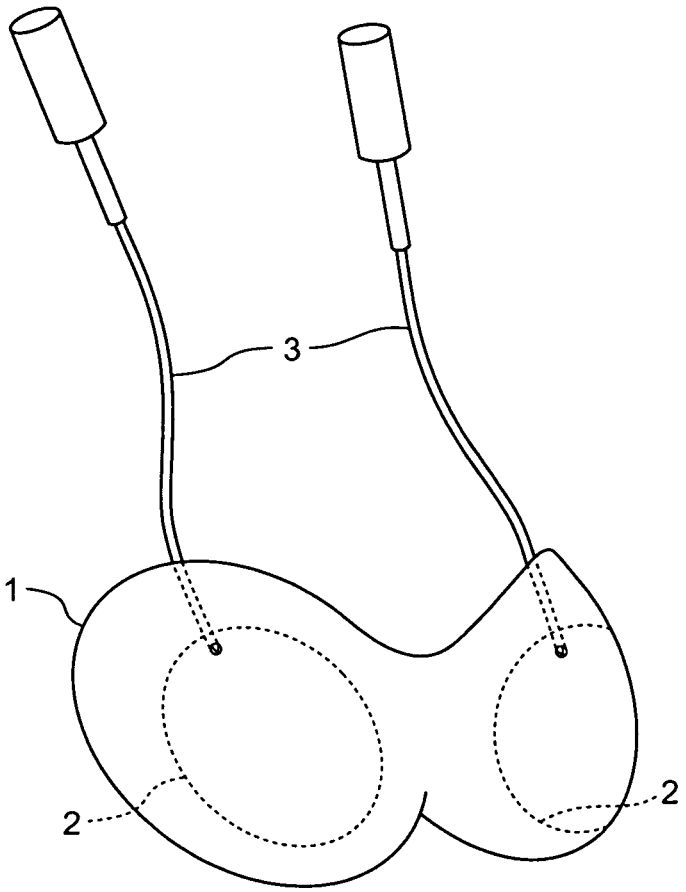
FIG. 4 is a perspective view of the breast garment shield wherein the shield is a mono-shield for two breasts.

In another embodiment, as shown in FIG. 4 the shield 1 can be a one-piece shield that accommodates two breasts in a single shield. In the case of a single double breast shield, the shield has two cups therein with individual bladders, each having their own tube and pump arrangement for individual volume control. The inner and outer face materials are as described above for the first embodiment of the invention. The bladder material and filling substance are also as described above.

The shape of the individual shields shown in FIG. 1 are generally oval and physically complementary to the shape of a female breast. The bra A may have air management material incorporated therein such as moisture wicking material and air breathing material. A breast shelf 20 may be incorporated under the shields to keep the shields in place relative to the breasts. The breast shelf 20 is a banded structure having layers of material to create a supportive area for the breasts to lie on. It may also be a wide band of elastic material. The shelf disperses the weight of the breasts away from the torso.

A sports bra A or other female garment that contains the shield in a pocket(s) therein is also a part of this invention. The bra or garment preferably has a harness 21 having one or two pockets for accommodating a breast protection shield(s). The sports bra or other garment preferably has a harness with adjustment means 22 for tightening the shields to the breasts to provide enhanced breast protection to said user.

A method of protecting breasts from blunt impact force is described as providing a breast shield as described herein, inserting the breast protection shield into a sports bra, applying the sports bra or other garment to the user so that the shield(s) cover the breasts of the user, inflating the breast shield to conform to the shape of the breasts, adjusting the garment to compress the shield onto the breasts of the user, and thereby protecting the breast tissue from injury.

What is claimed is:

1. A protective sports bra for protecting breasts of a user, said bra comprising:

a harness with one or more pockets for accommodating concave shields;

one or more concave shields positioned in the one or more pockets, each said shield for accommodating therein substantially an entire breast of said user above and below a midline of the breast, each shield comprising:

an inner face and an outer face with a cavity extending entirely there between, said outer face being rigid or semi rigid and adapted to protect the breast from blunt force trauma;

a fillable bladder positioned inside of the entire cavity, said bladder having a valve opening for filling and/or de-filling said bladder;

a filling system for delivering a filling substance through said valve of said bladder.

2. The protective sports bra of claim 1, wherein said valve is a self-sealing valve or a re-sealable valve.

3. The protective sports bra of claim 1, wherein said inner face of said shield is flexible to expand when said bladder is filled.

4. The protective sports bra of claim 1, further comprising a pump that is connectable to said valve for delivering a filling substance to said bladder.

5. The protective sports bra of claim 1, wherein said one or more concave shields are connected together to form a single shield wherein said outer faces form two concave shields that accommodate two breasts, each shield containing a separate fillable bladder.

6. The protective sports bra of claim 1, wherein said inner face is flexible.

7. The protective sports bra of claim 1, further comprising a filling substance inside of said bladder, said filling substance comprising: gas, liquid, gel, silicone, or polymer.

8. The protective sports bra of claim 1, wherein said valve is a one-way valve or a two-way valve.

9. The protective sports bra of claim 1, wherein said filling system for delivering a filling substance to said bladder is one or more tubes connected to said bladder(s) or removably connected to said bladder.

10. A method of protecting breasts from blunt force trauma comprising;

providing a protective sports bra of claim 1, donning said sports bra onto a user so that the one or more concave shields of said bra is over the breasts of said user;

filling said bladder of said one or more concave shields with a filling substance to a desired amount to conform to the shape of the breasts and provide custom fit of said sports bra to said breasts of said user.

11. A protective sports bra for protecting breasts of a user, said bra comprising:

a harness with one or more pockets for accommodating concave shields;

one or more concave shields positioned in the one or more pockets, each shield for accommodating substantially an entire breast of said user above and below a midline of said breast, each concave shield comprising:

an inner face and a rigid or semi rigid outer face with a cavity formed between the entire inner face and entire outer face, said outer face adapted to protect said breast from blunt force trauma;

a valve positioned in said one or more shields to permit filling and/or de-filling of said one or more shield's entire cavity;

a filling system for delivering a filling substance through said valve and to said cavity.

12. The protective sports bra of claim 11, wherein said harness has an adjustment device for tightening said protective sports bra to said user.

13. The protective sports bra of claim 11, wherein said bra further has boning strips in the vicinity of the one or more concave shields for providing additional support to said bra.

14. The protective sports bra of claim 11, wherein said bra further comprises a support shelf positioned around a lower edge of said bra underneath the pockets for supporting the breasts of the user.

15. The protective sports bra of claim 11, wherein said pockets have openings for inserting and removing said one or more concave shields from said bra.

16. The protective sports bra of claim 11, further comprising a closure device for closing said pockets.

17. A method of protecting breasts from blunt force trauma comprising;

providing a protective sports bra of claim 10;

inserting said one or more concave shields of said sports bra into said one or more pockets;

donning said sports bra onto a user so that the breast receiving portion of said sports bra is over breasts of said user;

filling said cavity of said one or more concave shields with a filling substance to a desired amount to provide protection and custom fit of said one or more concave shields to said substantially entire breasts of said user.

18. A kit for protecting breast tissue from blunt force trauma, said kit comprising:

a.) one or more concave shields wherein each of said shields is large enough to accommodate an entire outward surface of a breast, each said concave shield comprising:

(i) an inner face and an outer face with a cavity formed entirely between said inner and outer faces, said outer face being rigid or semi rigid to protect the breast tissue from blunt force trauma;

(ii) a fillable bladder positioned inside of said entire cavity, said bladder having a valve opening for filling and/or de-filling said bladder;

b) a sports bra having one or more pockets which receive said one or more concave shields;

c) a filling substance; and d.) a tube that fits into said valve for filling said bladder with said filling substance.

19. A protective sports bra for protecting breasts of a user, said bra comprising:

a harness with one or more pockets for accommodating concave shields; one or more concave shields positioned in the one or more pockets, each said shield for accommodating therein substantially an entire breast of said user above and below a midline of the breast, each shield comprising:

an inner face and an outer face with a cavity extending entirely there between, said outer face being rigid or semi rigid and adapted to protect the breast from blunt force trauma;

a fillable bladder positioned inside of the entire cavity, said bladder having a valve opening for filling and/or de-filling said bladder; and a filling substance inside of said bladder.

* * * * *